United States Patent [19]

Sowers et al.

[11] 4,324,617

[45] Apr. 13, 1982

[54] INTERMEDIATE HEAT EXCHANGER FOR A LIQUID METAL COOLED NUCLEAR REACTOR AND METHOD

[75] Inventors: Michael G. Sowers, Hixson; Ronald B. Creek, Chattanooga; Donovan D. DeFur, Hixson, all of Tenn.

[73] Assignee: Electric Power Research Institute, Inc., Palo Alto, Calif.

[21] Appl. No.: 34,165

[22] Filed: Apr. 27, 1979

[51] Int. Cl.[3] ..... G21C 15/00

[52] U.S. Cl. ..... 376/405

[58] Field of Search ..... 176/64, 65, 87

[56] References Cited

U.S. PATENT DOCUMENTS

| | | | |
|---|---|---|---|
| 3,784,443 | 1/1974 | Vercasson | 176/64 |
| 3,932,214 | 1/1976 | Aubert et al. | 176/65 |
| 3,962,032 | 6/1976 | Berniolles et al. | 176/65 |
| 4,032,399 | 6/1977 | Detauchy et al. | 176/65 |
| 4,043,866 | 8/1977 | Durston | 176/65 |
| 4,087,325 | 5/1978 | Chevallier et al. | 176/65 |
| 4,101,377 | 7/1978 | Berniolles et al. | 176/65 |
| 4,115,192 | 9/1978 | Jogand | 176/65 |
| 4,167,445 | 9/1978 | Aubert et al. | 176/65 |

FOREIGN PATENT DOCUMENTS

| | | | |
|---|---|---|---|
| 2036828 | 12/1970 | France | 176/65 |

*Primary Examiner*—Sal Cangialosi

*Attorney, Agent, or Firm*—Flehr, Hohbach, Test, Albritton & Herbert

[57] ABSTRACT

An intermediate heat exchanger for a liquid metal cooled nuclear reactor and method. The heat exchanger includes a plurality of thermally uncompensated tubes mounted in the heat exchanger for carrying a liquid metal heating fluid from a hot pool to a cool pool in the nuclear reactor and a shell enclosing these tubes for bringing a liquid metal heated fluid into thermal communication with both said tubes and said heating fluid. In operation the shell is heated by thermal communication with the hot pool to a temperature substantially greater than the temperature of the tubes. The elevated temperature of the shell stresses the tubes in tension and the heat exchanger is thereby capable of accommodating differential thermal expansion.

11 Claims, 3 Drawing Figures

INTERMEDIATE HEAT EXCHANGER FOR A LIQUID METAL COOLED NUCLEAR REACTOR AND METHOD

The present invention generally relates to tube and shell heat exchangers and, in particular, to thermal expansion compensation techniques for such heat exchangers.

A heat exchanger is used to transfer heat from a heating fluid to a heated fluid. A tube and shell heat exchanger includes a plurality of tubes thorugh which one of the fluids is directed. The tubes, collectively called a tube bundle, are rigidly mounted between two tube sheets. The tube bundle is enclosed within a shell which directs one of the two flowing fluids around the outside of the tubes. In operation one of the fluids passes through the tubes and the other fluid passes around the outside of the tubes within the shell so that thermal communication and heat transfer occurs across the tube walls.

The heat exchanger disclosed herein is used in a multi-pool, liquid metal cooled, nuclear reactor. The heat exchanger acts as a thermal interface between the radioactive primary sodium circulating through the nuclear reactor and the nonradiocative intermediate sodium which circulates through the steam generator. The primary sodium is the heating fluid and the intermediate sodium is the heated fluid. The heat exchanger is physically located within the reactor vessel so that heat can be extracted from the reactor while keeping the radioactive fission products in the primary sodium within the confines of the reactor vessel.

One problem associated with such intermediate heat exchangers used in liquid metal cooled nuclear reactors is accomodating for the differential thermal expansion between the structural components of the heat exchanger. In a typical liquid metal cooled reactor the average temperature of the primary sodium (heating fluid) to the intermediate heat exchanger is approximately 735° F. and the intermediate sodium (heated fluid) average temperature is 670° F. Thus, there is a temperature difference of 65° F. within the heat exchanger. Most intermediate heat exchangers incorporate either bent tubes or bellows joints in order to accomodate for this thermal differential. Although these mechanical devices operate satisfactorily, they require complex manufacturing procedures and frequent inspection during operation.

A further problem with intermediate heat exchangers in multi-pool nuclear reactors is the maintenance of a high primary sodium flow rate through the heat exchanger while avoiding a large pressure drop. In a multi-pool reactor there is no piping used to direct primary sodium either to or from the intermediate heat exchanger. The primary coolant pumps force the primary sodium from the lower or cold pool through the reactor core into an upper or hot pool. The only driving head causing primary flow through the intermediate heat exchanger is the relatively small elevation differential between the upper hot pool and in the lower cold pool.

The present invention is achieved by an improved tube and shell heat exchanger for a liquid metal cooled, multi-pool, nuclear reactor. The heat exchanger includes a plurality of thermally uncompensated tubes mounted in the heat exchanger for carrying a liquid metal heating fluid from a hot pool to a cold pool in the nuclear reactor. The heat exchanger also includes a shell enclosing said tubes for bringing a liquid metal heated fluid into thermal communication with both said tubes and said heating fluid thereby heating said heated fluid. The heated fluid is directed into and out of the heat exchanger shell by nozzle means connected to the heat exchanger shell.

The invention is also achieved by a method for accomodating differential thermal expansion in a tube and shell heat exchanger for a liquid metal cooled, multi-pool, nuclear reactor. The method includes the steps of directing a heatinfg fluid from a hot pool in the nuclear reactor through a plurality of tubes in a heat exchanger and thereafter into a cold pool in the nuclear reactor. The heated fluid is directed through the shell of the heat exchanger and into thermal communication with both the tubes and the heating fluid therein. The method further includes the steps of heating the shell to a temperature substantially greater than the temperature of the tubes by thermal communication with the hot pool and tensioning said tubes during operation by said heating of the shell and thereby accomodating differential thermal expansion in the heat exchanger.

One object of the present invention is to accomodate differential thermal expansion in an intermediate heat exchanger between the shell, the tubes, and the tube sheet without using mechanical devices. As disclosed below the tubes within the tube bundle and the heat exchanger shell are straight and require no bends, bellows joints, slip joints, or other mechanical devices.

The avoidance of bent tubes simplifies many of the manufacturing procedures and eliminates most of the subsequent inspection and repair of the heat exchanger. The avoidance of bellows joints eliminates the necessity for continuously monitoring the heat exchanger for bellows failure and also increases the reliability of the heat exchanger. Further, by eliminating the need for a mechanical device to accomodate for differential thermal expansion, the heat exchanger of the present invention has an increased ratio of effective tube length to actual tube length.

The last named object is achieved by placing the shell of the heat exchanger in communication with the hot pool of the reactor and by adjusting the length of the shell in contact with the hot and cold pools so that the tubes within the heat exchanger are normally stressed in tension.

An additional object of the present invention is to more easily and securely attach the tubes in the tube bundle to the upper and lower tube sheets. This object is achieved because during fabrication the tubes, tube sheets, and shell are not placed in tension.

A further object of the present invention is to ensure that the primary sodium flows through the heat exchanger with a very low pressure drop and that the primary and secondary sodium both flow through the heat exchanger with a uniform flow distribution. These objects are achieved by directing the flow of primary sodium through the tubes of the heat exchanger and by directing the intermediate sodium through the shell. The embodiment described herein achieves a primary flow distribution in the tubes of $\pm 5\%$.

Still another feature of the present invention is to provide sufficient design margins in the heat exchanger to avoid tube buckling during transient conditions. This object is achieved by stressing the tubes in tension during normal operation and thus compressing the shell.

Additional features and objects of the invention will appear from the following description in which the preferred embodiment has been set forth in detail in conjunction with the accompanying drawings.

Figure 1A:
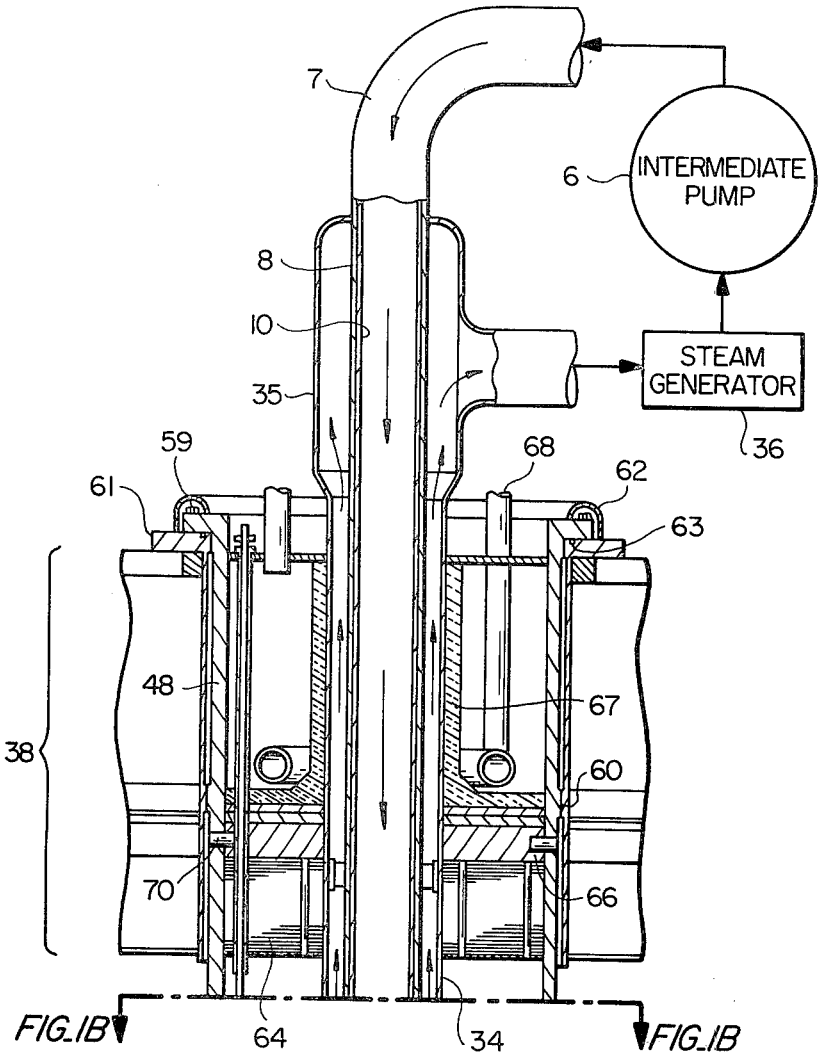
FIGS. 1A and 1B are diagrammatic side elevational views of an intermediate heat exchanger according to the present invention.
Figure 2:
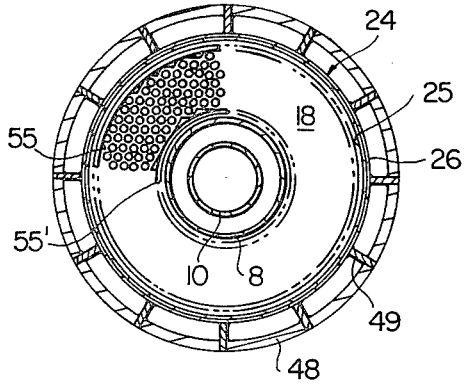
FIG. 2 is a top plan view, in section taken along line 2—2 of FIG. 1B, showing the intermediate heat exchanger.
Figure 1B:
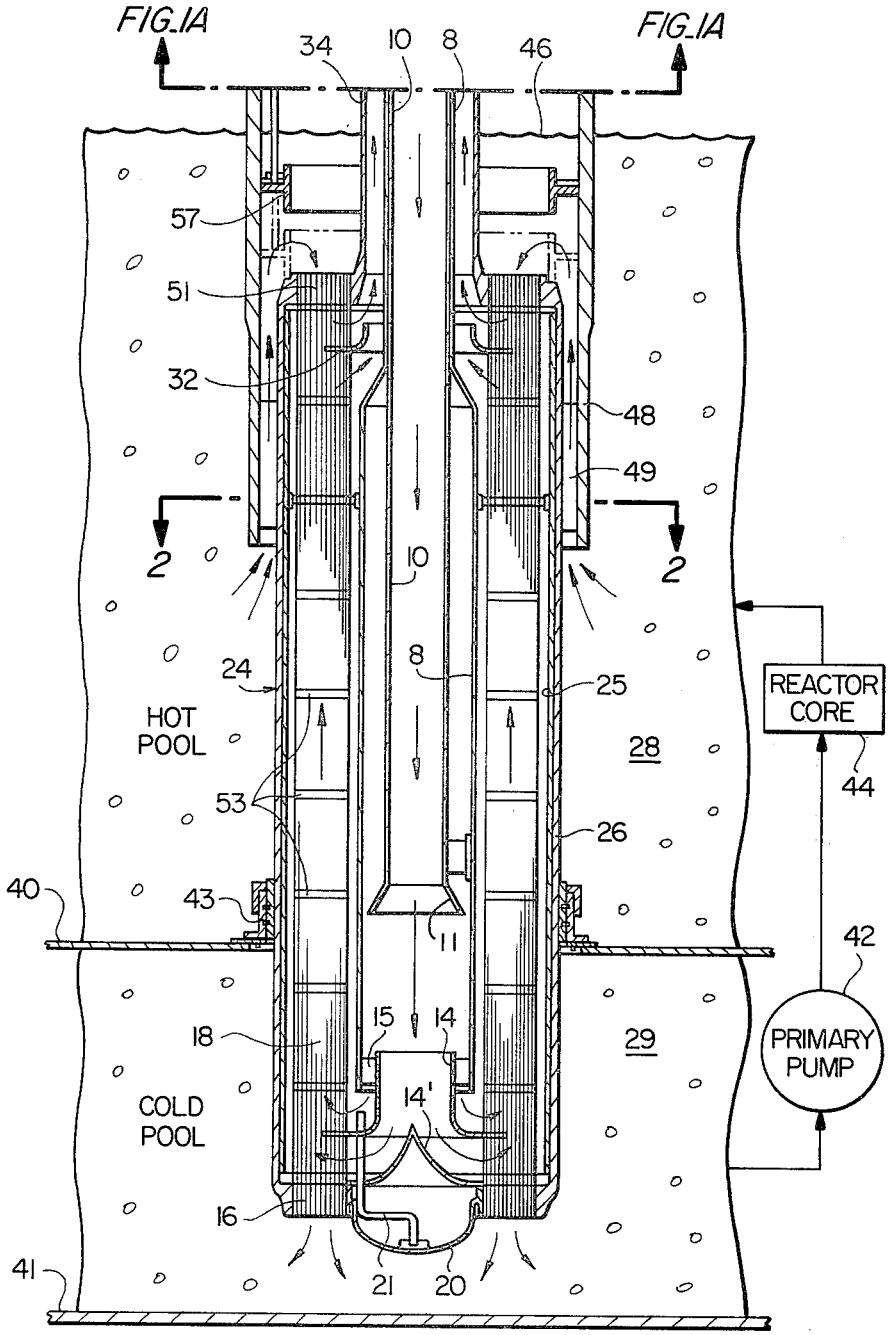

In general, FIGS. 1A 1B, and 2 illustrate an intermediate heat exchanger for a multi-zone, sodium cooled, pool-type, nuclear reactor. The heat exchanger is a vertically oriented, top supported, shell and tube, counterflow heat exchanger designed for use as an intermediate heat exchanger (IHX) in a fast breeder reactor. The heat exchanger described herein has a design capability of 500 MWt and is one of six in a 3,000 MWt (1,000 MW gross electric) nuclear reactor.

Referring to FIG. 1A, the flow of intermediate sodium is through a closed, piped loop. After returning from the steam generator 36, the sodium is directed by an intermediate coolant pump 6 into an inlet nozzle 7 of the intermediate heat exchanger. The nozzle terminates in a central downcommer pipe 10 which transports the cooler intermediate sodium down through the center of the heat exchanger. The downcommer forms a flare 11, FIG. 1B at its lower end. The sodium makes an essentially isothermal passage through the downcommer to the lower extremity of the tube bundle. The downcommer is encased in a co-axial volumetric displacing tube 8. The side wall of the downcommer 10 and the side wall of the volumetric displacing tube 8 have different diameters and thus an annulus is formed between these two components as shown in FIG. 1B. The annulus serves to insulate the incomming intermediate sodium in the downcommer from the exiting intermediate sodium in the riser 34 thus reducing regenerative heat. The exiting intermediate sodium has been heated by the primary sodium from the reactor.

The flow of intermediate sodium passes out of the volumetric displacing tube 8, FIG. 1B and is directed into two turning vanes 14, 14' located in the bottom portion of the heat exchanger. These turning vanes are axially symmetric about the center line of the heat exchanger and direct the flow of intermediate sodium from the downcommer radially outward in cross-flow into the shell side of the heat exchanger. The intermediate sodium is thereby brought into thermal communication with the tubes 18 and begins to flow upward while receiving heat through the tube walls from the counterflowing primary sodium.

The upper turning vane 14, FIG. 1B is suspended by a plurality of webs 15 from the displacing tube 8. The upper turning vane has a generally cylindrical upper portion which flares outward so that its side walls are generally horizontal. The lower turning vane 14' has a conical shape with an upwardly directed apex and is axially symmetric to the heat exchanger. Below the turning vanes 14 is located a sump 20. The sump 20 and drain line 21 are provided for the purpose of removing the intermediate sodium from the heat exchanger should it ever become desirable to do so for the purpose of removing the heat exchanger from the reactor vessel.

After leaving the turning vanes 14,14' FIG. 1B the intermediate sodium passes through the shell side of the heat exchanger. The flow is upwardly directed through the annular spaced formed between the outside diameter of the displacing tube 8 and the inside diameter of the inner cylindrical side wall 25. The outer cylindrical side wall 26 is physically attached to the upper and lower tube sheets 51, 16 and is the structural component that stresses the tubes in tension during normal operations. The outer cylindrical side wall is in thermal communication with both the hot pool 28 and the cold pool 29 of the reactor. The inner cylindrical side wall 25 is spaced slightly away from the outer cylindrical side wall 26 in such a way as to provide an insulating barrier which tends to thermally isolate the outer cylindrical side wall from the intermediate sodium flowing around the tubes in the heat exchanger. The inner insulating cylindrical side wall permits the outer side wall to operate closer to a temperature determined by the hot pool 28 and the cold pool 29 and to be substantially less affected by the temperature of the intermediate sodium. The inner side wall is supported by the outer side wall and is not attached to the tube sheets.

After the intermediate sodium passes upwardly around the tubes 18, FIG. 1B, the intermediate sodium is directed by an upper turning vane 32 radially inward in cross-flow into a vertical riser 34. The upper turning vane is supported from the displacing tube 8 and is axially symmetric around the center line of the heat exchanger. The intermediate sodium flows upward in the annular space between the outside surface of the side wall of the displacing tube 8 and the inner surface of the riser side wall 34. The sodium thereafter flows into an outlet plenum 35, through a nozzle, and onto the steam generator 36, FIG. 1A. It should be noted that the displacing tube 8 and the riser 34 are co-axial and concentric in order to minimize the number of penetrations through the reactor vessel cover 38, FIG. 1A.

After leaving the heat exchanger, the intermediate sodium passes through the steam generator 36, FIG. 1A where the heat received from the primary sodium is utilized to generate steam and ultimately electric power. The intermediate sodium next leaves the steam generator and is pumped by the intermediate coolant pump 6 back into the intermediate heat exchanger to repeat the above-described cycle.

The flow of primary sodium through the intermediate heat exchanger begins in the cold pool 29, FIG. 1B. The cold pool is formed by the bottom of the reactor vessel 41, its sides (not shown) and the redan 40. The redan is a horizontal, low stress, plate structure that spans across the inside of the reactor vessel and separates the hot pool 28 from the cold pool 29. The redan is connected to the outside of the heat exchanger shell by a spring loaded labyrinth seal 43. The primary sodium in the cold pool is drawn by a primary pump 42 into the core 44 of the reactor, is heated therein and is thereafter discharged into the hot pool 28. The hot pool is formed bewteen the redan 40, the sides of the reactor vessel (not shown) and the upper operating sodium level 46.

After being heated by the reactor, the sodium in the hot pool 28, FIG. 1B, enters the intermediate heat exchanger by passing around the bottom edge of a cylindrical support skirt 48. The cylindrical support skirt supports the shell 24 of the heat exchanger by a plurality of radial webs 49, FIGS. 1B, 2. The hot primary sodium passes up the annulus between the shell 24 and the inside surface of the cylindrical support skirt. The primary sodium thereafter flows into an inlet plenum located above the upper tube sheet 51. The hot sodium then enters the tubes 18. The lower end of the cylindrical support skirt 48 is positioned substantially below the operating level 46 of the sodium in the reactor in order to ensure that the sodium which is drawn into the intermediate heat exchanger has a temperature that is representative of the average bulk temperature of the sodium in the hot pool.

After the primary sodium enters the tubes 18, FIG. 1B, the sodium flows downward through the length of the tube bundle, giving up heat through the tube walls and thereby heating the intermediate sodium. The primary sodium exits the heat exchanger through the lower tube sheet 16 and goes directly into the cold pool 29.

In one embodiment of the present invention the displacing tube 8 has a diameter of 762 mm (30 in.) and the riser has a diameter of 1067 mm (42 in.). The flow rates and temperatures of the primary and secondary sodium through the heat exchanger are tabulated below:

| | Mass Flow Rate | | Inlet Temp. | | Outlet Temp | |
|---|---|---|---|---|---|---|
| | KG/Sec. | Lbm/hr. × $10^6$ | °C. | °F. | °C. | °F. |
| Primary Sodium | 2495 | (19.8) | 468 | (875) | 311 | (591) |
| Intermediate Sodium | 2772 | (22.0) | 285 | (545) | 427 | (800) |

The primary and secondary side pressure drops through the heat exchanger are 17.2 kPA (2.5 psi) and 103.4 kPA (15.0 psi), respectively.

The total dry weight of the heat exchanger is approximately 208.6 t (230 tons). The unit extends downward approximately 15 m (50 ft.) from the top of the support flange 61 to the lower surface of the lower tubesheet 16 and upward approximately 5 m (17 ft.-3 in.) to the upper extremity of the intermediate sodium inlet pipe 7. Thus, the overall length of the heat exchanger is approximately 20 m (67 ft.-3 in.). Extreme diameters are 3658 mm (144.00 in), 3226 mm (127.00 in.), and 2651 mm (104.38 in.), respectively for the support flange 61, the support skirt 48, and the tube bundle shell 26. The dimension over the tubesheets is 9144 mm (30 ft.-0 in.) and the heated length of the tubes is 8534 mm (28 ft.-0 in.).

The tubes 18, FIG. 1B are mounted between the tube sheets 16, 51, FIG. 1B in a triangular pitched array. Each tube is straight, smooth and vertical. The tubes are connected to the tube sheets during fabrication in an untensioned state. The tube-to-tube sheet joint is made by explosively expanding the tubes into the tube sheet holes and welding them on the primary sodium side. The outer cylindrical wall of the shell 26 is welded to the tube sheets at the tube sheet mid-plane. The tube bundle is supported at several levels along the length of the heat exchanger by grid type tube supports 53. The tube supports are attached to the inner side wall 25 of the shell. This support technique raises the natural frequency of the short spans of tubing and thus prevents the formation of destructive vibration modes in the tubes during operation.

Referring to FIG. 2, the heat exchanger is constructed so that the tubes 18 are contained as intimately as possible within the annulus formed by the displacing tube 8 and the inner shell 25. Since the tubes are arranged in a triangular pitched array, an inner and an outer seal plate 55, 55' is provided at each tube support 50, FIG. 1B to fill the spacing between the tubes and the displacing tube and the inner shell. These seal plates force any peripheral fluid back into the tube bundle for mixing and preclude gross, straight through sodium streaming or bypassing of the heated surfaces of the tube.

In one embodiment described herein the tube bundle is comprised of 2,826 tubes placed in a triangular array with a center to center pitch of 37.2 mm (1.466 in.). In this embodiment there are 366 surplus tubes in the bundle to allow for contingencies. The heated length of the tubes is 8534 mm (28 ft.-0 in.). The tubes have a nominal 28.6 mm (1.125 in.) outside diameter with an average wall thickness of 1.14 mm (0.45 in.). Both tube sheets 16, 51 are 305 mm (12.00 in.) thick and have the 38 mm (1.50 in.) outer cylindrical side wall 26 of the shell welded to them. The egg crate tube supports 53 are fabricated from rectangular bars 3.2 mm (0.125 in.) in thickness. The eight tube supports are located 94 mm (37.00 in.) apart along the length of the tube bundle. The inner side wall 25 of the shell is 25 mm (1.00 in.) thick and the flow shroud is 13 mm (0.5 in.) thick.

The heat exchanger is supported from the reactor vessel cover 38, FIG. 1A. The cylindrical support skirt 48 is secured to the vessel cover by a plurality of bolts 59. The weight of the entire lower assembly consisting of the tube bundle, the shell, the downcommer and riser pipes, the tube sheets etc. is transmitted to the lower portion of the support skirt 48 by a plurality of radial webs 49, FIGS. 1B, 2. These webs bridge across the primary sodium inlet annulus. Thus, vertical loads are taken at the vessel cover 38 by the bolts 59. Horizontal loads are taken as a couple between the bolts 59 and a set of circumferentially machined surfaces 60, FIG. 1A on the inner surface of the cylindrical side wall of the cover 38. The reactor is sealed by a metallic O-ring seal 63 and a welded membrane seal 62 having an inverted J-shaped cross-section that covers the bolts 59.

Referring to FIG. 1A, the upper end of the heat exchanger contains a horizontal layer of thin, steel plates 64 that act as reflective thermal insulation. These plates are suspended from a layer 66 of thicker plates which act as a biological shield and absorb fast neutrons. The top of the biological shield 66 and the side wall of the riser 34 are shielded by a layer 67 of thermal insulation which limits the heat losses in these areas. The plenum formed by the thermal insulation 67 and the cylindrical support skirt 48 is cooled by a gas circulation duct 68. The gas circulation duct cools the cylindrical support skirt while the thermal insualtion 67 reduces the amount of heat lost from the riser. The biological shield 66 and the layers of thermal insulation 64, 67 are supported by a plurality of horizontally disposed shear pins 70 that are attached to the cylindrical support skirt 48.

In the embodiment described herein the upper end of the heat exchanger includes 717 mm (28.25 in.) of steel plate stock. The reflective thermal insulation 64 consists of forty pieces of 2.5 mm (0.10 in.) thick steel stock spaced 19 mm (0.75 in.) apart. The biological shields consist of three plates: one plate 330 mm (13 in.) and two plates 108 mm (4.25 in.) thick.

The flow of primary sodium through the heat exchanger is controlled by a mechanical isolation valve 57, FIG. 1B. The isolation valve has a generally cylindrical shape with a T-shaped cross-section. In its closed position the valve blocks the primary sodium flow by closing the annulus between the top of the tube sheet 51 and the inner side wall of the support skirt as illustrated in phantom lines. The purpose of this valve is to isolate the heat exchanger for removal and to prevent damage to the heat exchanger during extreme transient conditions. The valve is raised and lowered by a plurality of ball screw actuators coupled to a single electric gear motor (not shown).

The volumetric displacing tube 8, FIG. 1B establishes a flow channel for the incoming intermediate sodium that has the same diameter as the downcommer 10 through the inlet nozzle 7. Referring to FIG. 1B, the inside diameter of the tube bundle 18 is determined by the outside diameter of the riser 34. In other words, the inside diameter of the tube bundle physically can be no smaller than the outside diameter of the riser. The upper part of the displacing tube is designed to be concentric with and contained inside of the riser as illustrated in FIG. 1A. When the displacing tube enters the tube bundle, it flares immediately outward below the upper turning vane 32 to minimize the spacing between the tube bundle and the displacing tube 8. The dimensioning is done in order to minimize the amount of primary sodium flowing in the shell which does not come into thermal communication with the tube bundle. The volumetric displacing tube 8 also minimized regenerative heat by providing an insulating barrier of relatively stagnant fluid between the incoming intermediate sodium in the downcommer and the exiting intermediate sodium in the tube bundle.

The heat exchanger is constructed by first drilling the tube sheets 16, 51, thereafter attaching the shell 24, and installing the displacing tube 8 and the riser 34 therein. Next the egg crate tube supports 53 are installed and optically aligned in registration with the holes in the tube sheets. The tubes are installed by simply inserting them through the tube supports and explosively expanding and welding them to the tube sheets in the conventional manner. The tubes are installed without being placed in tension and the entire heat exchanger is constructed without prestressing. It should be noted that the tubes contain no bends or bellows that could interfere with the straight insertion of the tubes into the tube sheets.

In the embodiment described herein the heat exchanger is fabricated to meet the requirements of Section III, Class 1 of the ASME Boiler and Pressure Vessel Code for Nuclear Components, including Code Case 1592. The entire heat exchanger is constructed from Type 304 Stainless Steel.

The heat exchanger described herein is able to avoid the use of bellows joints, floating heads, and bent tubes by operating between the compressive limits of the tube bundle and the shell. This mode of operation is afforded by two design features. Firstly, the shell is immersed both in the hot pool 28 and the cold pool 29. The redan 40 between the hot and cold pools is positioned so that the amount of thermal expansion which the shell 24 undergoes is controlled. The selection of the proper ratio of shell length contacting these two pools affords this heat exchanger with the ability to function during operation with the tubes in tension. During most operations the shell is at a higher temperature than the tubes. The shell thereby stresses the tubes in tension due to the difference in thermal expansion, and when the tubes are thus stressed in tension, compressive tube buckling is avoided. Secondly, the outer cylindrical sidewall 26 of the shell is thermally insulated from the cooler intermediate sodium by the inner sidewall 25. The outer sidewall is thereby able to achieve a higher temperature approximating the temperature of the pools.

In the embodiment described herein the bottom of the tube sheet 16 is located at elevation 50 ft. 1 in. relative to the defined reference elevation 100 ft. 0.0 in. at the reactor deck upper surface. The redan 40 is located at elevation of 60 ft. 2 in., the top of the upper tube sheet 51 is located at elevation 80 ft. 1 in. and the operating sodium level 46 is located at elevation of 84 ft. 4 in. In addition the top of the O-ring 61 is located at elevation 100 ft.

It should be appreciated that in the heat exchanger described herein the primary sodium flows through the tube side of the heat exchanger and there are no hinderances to limit direct access to the tube sheets. This design simplifies decontamination of the heat exchanger and provides for direct inspection and repair of the tubes and tube-to-tube sheet welds.

It should also be noted that the straight tube design described herein is much easier to fabricate then a bent tube design. In addition, since the bent regions of the tubes are often difficult to support, many bent tube type heat exchangers have a lower ratio of heat transfer length to actual tube length than the straight tube heat exchanger disclosed herein.

Further, the heat exchanger avoids the use of bellows joints and floating heads. Although bellows joints provide a more straight forward approach to analyzing the effects of differential thermal expansion between the shell and the tube bundle, these elements are fragile and require constant survelance for failures. In addition, these components tend to reduce the overall reliability of the heat exchanger.

Thus, although the best mode contemplated for carrying out the present invention has been herein shown and described, it will be apparent that variation and modification may be made without departing from what is considered to be the subject matter of the present invention.

What is claimed is:

1. A tube and shell heat exchanger for a liquid metal cooled, multi-pool, nuclear reactor comprising:

(a) a plurality of thermally uncompensated tubes mounted in a heat exchanger for carrying a liquid metal heating fluid from a hot pool to a cold pool in the nuclear reactor;

(b) a thermally uncompensated and thermally expandable heat exchanger shell enclosing said tubes for bringing a liquid metal heated fluid into thermal communication with both said tubes and said heating fluid thereby heating said heated fluid, said shell being simultaneously immersed in both the hot pool and the cold pool to an extent that the temperature of the shell is higher than the temperature of the tubes whereby to cause said shell to expand to a greater extent than said tubes, said shell being inter-connected with said tubes such that the difference in thermal expansion therebetween places said tubes in a state of tension; and (c) nozzle means connected to the heat exchanger shell for directing the heated fluid into and out of said heat exchanger.

2. An apparatus as in claim 1 wherein the hot pool has an average operating temperature of about 468° C. (875° F.) and the cold pool has an average temperature of about 311° C. (591° F.).

3. Method for accomodating differential thermal expansion in a tube and shell heat exchanger for a liquid metal cooled, multi-pool, nuclear reactor, comprising the steps of:

(a) directing a heating fluid from a hot pool in the nuclear reactor through a plurality of tubes in a heat exchanger and thereafter into a cold pool in the nuclear reactor;

(b) directing a heated fluid through the shell of the heat exchanger and into thermal communication with both the tubes and the heating fluid therein;

(c) interconnecting said tubes and shell together such that an increase in expansion of said shell over that of said tubes places the latter in a state of tension; and (d) heating the shell to a temperature substantially greater than the temperature of the tubes by thermal communication with the hot pool whereby to cause said shell to expand to a greater extent than said tubes and thereby place said tubes in a state of tension in order to accomodate themal expansion in the heat exchanger.

4. A method as in claim 3 including the steps of:

(a) submersing the heat exchanger in the hot and cold pools to a measured extent and thereby heating the shell by said submersion to a temperature substantially greater than the temperature of the tubes; and (b) interconnecting said shell and tubes together so as to cause said state of tension by means of spaced-apart, registered tube sheets.

5. A tube and shell heat exchanger for a liquid metal cooled, multi-pool, nuclear reactor comprising:

(a) a plurality of thermally uncompensated tubes mounted in a heat exchanger for carrying a heating fluid from a hot pool to a cold pool in the nuclear reactor;

(b) a thermally uncompensated and thermally expandable heat exchanger shell enclosing said tubes for bringing a heated fluid into thermal communication with both said tubes and said heating fluid thereby heating said heated fluid, said shell being immersed in at least one of said hot and cold pools to an extent that the temperature of the shell is higher than the temperature of the tubes whereby said shell expands to a greater extent than said tubes;

(c) means interconnecting said shell with said tubes such that the difference in thermal expansion therebetween places said tubes in a state of tension; and (d) nozzle means connected to the heat exchanger shell for directing the heated fluid into and out of said heat exchanger.

6. An apparatus as in claim 5 wherein said shell is immersed partially in said hot pool and partially in said cold pool.

7. An apparatus as in claim 5 wherein the heat exchanger tubes and shell are unstressed with respect to each other at ambient temperatures.

8. An apparatus as in claim 5 including a thermal barrier located inside of the heat exchanger for thermally insulating the shell from the heated fluid therein so that the shell has a temperature approximating the temperature of the fluid in which the shell is immersed.

9. An apparatus as in claim 5 wherein said nozzle means includes a centrally located intake downcommer and a concentric outlet riser co-axial with said downcommer.

10. An apparatus as in claim 5 wherein the heating fluid circulated in the heat exchanger tubes is primary sodium containing the radioactive fission products and the heated fluid circulated in the heat exchanger shell is intermediate sodium for generating steam.

11. An apparatus as in claim 5 wherein said heat exchanger shell is thermally uncompensated.

* * * * *